US011628980B2

(12) United States Patent
Pierce

(10) Patent No.: US 11,628,980 B2
(45) Date of Patent: Apr. 18, 2023

(54) STRAPS TRASH BAG

(71) Applicant: Jasmine L. Pierce, Cedar Hill, TX (US)

(72) Inventor: Jasmine L. Pierce, Cedar Hill, TX (US)

( * ) Notice: Subject to any disclaimer, the term of this patent is extended or adjusted under 35 U.S.C. 154(b) by 0 days.

(21) Appl. No.: 17/166,195

(22) Filed: Feb. 3, 2021

(65) Prior Publication Data

US 2021/0237939 A1 Aug. 5, 2021

Related U.S. Application Data

(60) Provisional application No. 62/969,279, filed on Feb. 3, 2020.

(51) Int. Cl.
*B65D 33/28* (2006.01)
*B65F 1/00* (2006.01)

(52) U.S. Cl.
CPC ..... *B65D 33/28* (2013.01); *B65F 1/002* (2013.01)

(58) Field of Classification Search
CPC ... B65D 33/28; A45F 5/10; A45F 5/00; A45F 5/1026; A45F 3/14; B66C 1/12
USPC ..... 383/75
See application file for complete search history.

(56) References Cited

U.S. PATENT DOCUMENTS

| | | | | |
|---|---|---|---|---|
| 3,029,853 | A * | 4/1962 | Piazze | B65D 33/28 383/75 |
| 3,547,341 | A * | 12/1970 | Kirkpatrick | B65D 33/28 383/75 |
| 4,315,535 | A * | 2/1982 | Battle | B60J 11/00 150/166 |
| 4,850,946 | A * | 7/1989 | Broderick | B65D 33/28 493/194 |
| 9,493,299 | B2 * | 11/2016 | Town | B66C 1/226 |
| 2016/0332782 | A1 * | 11/2016 | Kiefer | B65D 33/28 |
| 2018/0118415 | A1 * | 5/2018 | Jean-Mary | B65F 1/0026 |

* cited by examiner

*Primary Examiner* — Derek J Battisti
(74) *Attorney, Agent, or Firm* — Leavitt Eldredge Law Firm

(57) ABSTRACT

The invention is an improvement to the drawstring trash bag. The invention features a plastic bag made from two panels, and the straps are made from elastic material. The straps consist of a drawstring connected to the supporting straps, and the supporting straps connected to the supporting base. The straps from an elastic material. An elastic drawstring is provided within hems running along the top of the two panels and elastic support straps run down the font of both panels and connect to the support base. The support straps along the front of both panels are made to have slack in the straps. When the trash bag is filled the slack in the straps will lessen. When the filled trash bag is pulled by the drawstring and straps the trash bag will be easy to remove from the receptacle.

1 Claim, 4 Drawing Sheets

STRAPS TRASH BAG

DESCRIPTION

The invention relates to improvements in the construction and manufacture of polymeric trash bags. The invention specifically improves the construction and manufacture of the drawstring trash bag, especially polymeric trash bags.

BACKGROUND OF THE INVENTION

Trash bags are usually formed from two panels, made from thermoplastic materials that are sealed along vertical sides. Polymeric trash bags are found everywhere in modern society, such as business, homes, institutions, schools and etc., and available in all types of varieties. The differences in the varieties are sizes, thickness, and color. There are three typically closure methods such as, straight top bags with twist tie closures, flapped bags where the flaps can be used to secure tie and carry the bag, and drawstring trash bags where the drawstring is provided within each hem that is a method for securing, tying, and carrying the trash bag. The invention is relevant to the draw tapes used in the drawstring trash bags, with added material.

Within the past few decades drawstring trash bags have increased commercial success as consumers realize the drawstring trash bag increased utility, which is mainly true in domestic households. Household's usage for drawstring trash bags are the most preferred trash bags used in kitchens settings.

Drawstring bags typically feature a drawstring located within each hem and anchored to the upper corners of the bag. The drawstrings on a trash bag are used to pull the trash bag closed, the drawstrings are intended to secure the mouth of the trash bag closed, and after the trash bag is filled with trash and tied the handles are used to carry the closed trash bag. It's been a tradition over the decades, such drawstrings were manufactured using primarily high density polyethylene that offer increased tensile strength. Compared to linear low density polyethylene or low density polyethylene. Newly improved drawstrings are being created that provide enhanced features and functions, mainly to secure the mouth of the trash bag on the trash receptacle.

With all that in mind it seems as if the problem of pulling a filled trash bag from the trash receptacle easily has yet to be resolved. The invention will provide everyday users a better way of pulling a filled trash bag from a trash receptacle. It is the mission of the invention to provide enhanced improvement to the plastic trash bag that is easily installed and removed from the trash receptacles. The invention will cover a few objects to improve the existence of trash bags. By providing an improved plastic trash bag that is economically affordable to manufacture and market. The invention improves plastic trash bags by having a support base on the bottom of the trash bag, when pulling the support straps/drawstring it creates momentum to pull from the bottom of the bag allowing the filled trash bag to be easily removed from the trash receptacle. The invention improves plastic trash bags by eliminating the struggle of pulling a fully loaded a trash bag by the mouth of the bag, which causes the bag to swell at the bottom.

SUMMARY OF THE INVENTION

The improved invention of the trash bag has an elastic structure to support the entire trash bag. The elastic structure consists of a drawstring connected to supporting straps that is connected to the supporting base, which is made to be one structure concept. Trash bags come in different sizes to fit different size trash receptacles. With the invention, depending on the trash receptacle will determine what size is needed for the receptacle.

The invention of an elastic supporting structure that supports the trash bag called "straps". Straps defined as a connectivity from the drawstring, supporting straps, and support base. The drawstring is within the hem of the trash bag that is connected to the supporting straps that run along the front of the both panels, down to the supporting base at the bottom of the bag.

The purpose of the invention is to eliminate the stress when pulling a filled trash bag from the receptacle. Pulling a filled trash bag by the neck of the bag causes all types of discomfort, mainly back discomfort. The invention improves support around the body of the trash bag, to minimize the struggle when pulling a filled trash bag from a trash receptacle. By using a support structure around the body of a trash bag, pulling the weight of the trash bag from the bottom will release the tension as opposed to pulling the trash bag from the next causing stress. The improved invention "Straps" allow the trash bag to be pulled mainly from the bottom of the bag. The drawstring will remain the same per usual, the major improvement is the supporting straps along the front of the bag on both panels and the supporting base. The straps are made to have slack until the trash bag is filled, so when pulling the trash bag the straps will extend in order to pull the weight of the trash bag from the bottom, allowing enough slack to still tie the drawstring up to close the trash bag. When the improved invention is removed from the trash receptacle, closing and securing the trash bag will be a breeze.

The elderly, housewives, and janitorial consumers will welcome the invention as a solution to common household and commercial problems. When imagining a filled trash bag in a receptacle and pulling the trash bag by the neck of the bag can become frustrating. The reason why, the trash fell to the bottom of the trash bag causing swelling inside the receptacle. Then the consumer is left to wrestle with the trash bag to remove it from the receptacle. With the improved invention elderly, housewives, and janitorial would admire how much easier it is to pull the trash bag from the trash receptacle. The invention will also prevent spills, leakage, and discomfort due to the supporting base layer by adding extra support when lifting the bag.

The invention provides improvement to the common trash bag which will allow fast and easy removing from the trash receptacle. That also prevents trash bags from swelling to the receptacle and prevents stress on the body when pulling a filled trash bag. The invention provides an improvement to the trash bag structure with a unique and convenient way of pulling trash from a receptacle.

DESCRIPTION OF THE DRAWING

FIG. 4 is a partial side elevation view illustrating the invention improvements made to the plastic trash bag, showing its concept structure when the trash bag is ready to be disposed of.

DETAILED DESCRIPTION OF THE INVENTION

Figure 1:
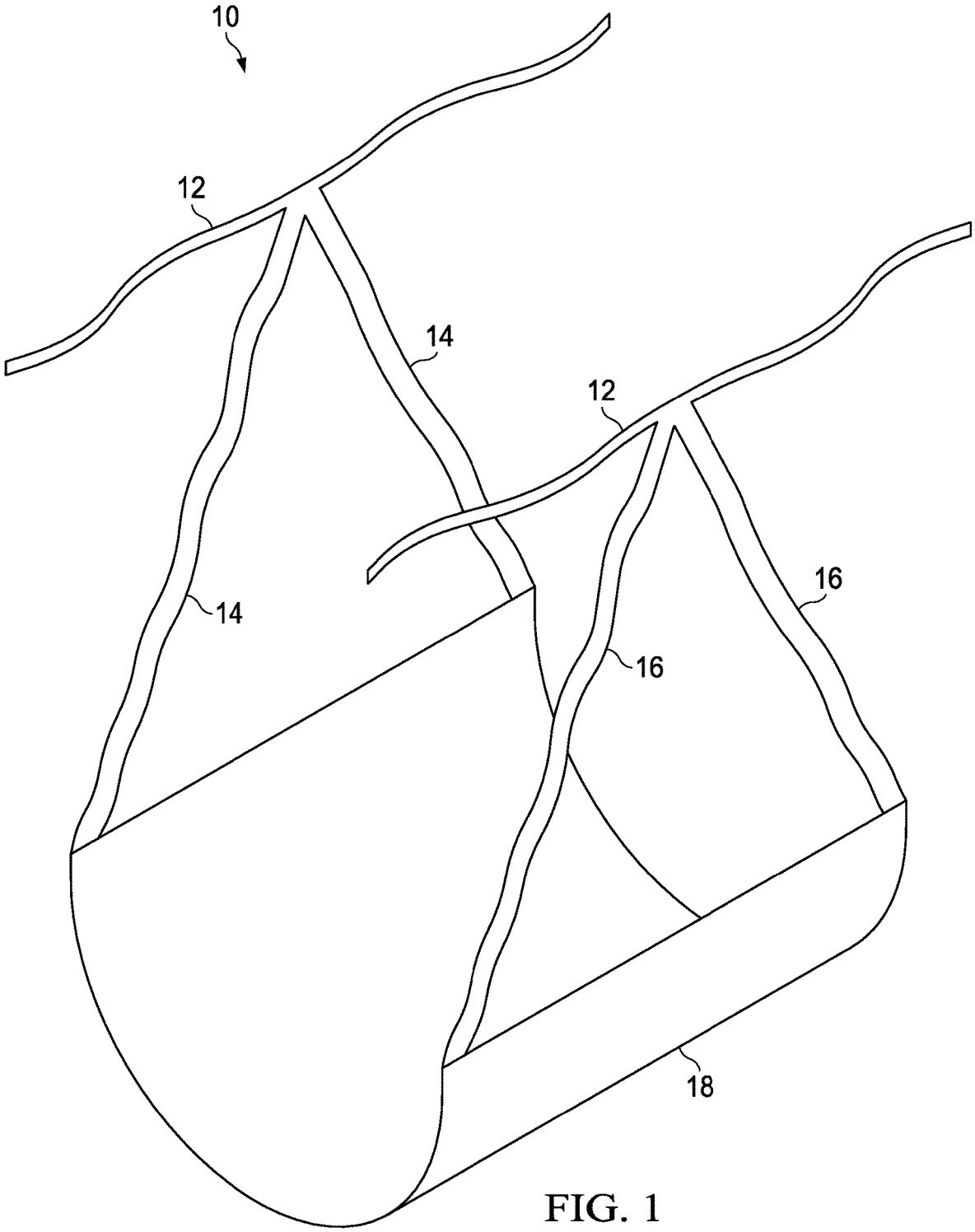
FIG. 1 is a front perspective view of the full elastic structure concept of the straps illustration.

The invention improvements to the plastic trash bag will now be described by referring to FIGS. 1-4 of the drawings. Referring initially to FIG. 1—numeral 10 refers to the entire assembly in each FIG of 1-4.

FIG. 1 numeral 10 refers to the entire assembly of the support straps. Numeral 12 refers to the drawstring. Numeral 14 refers to the support straps with slack on one side (left) of the trash bag. Numeral 16 refers to support straps with slack on the other side (right) of the trash bag.

Numeral 18 refers to the support at the base of the trash bag.

Figure 2:
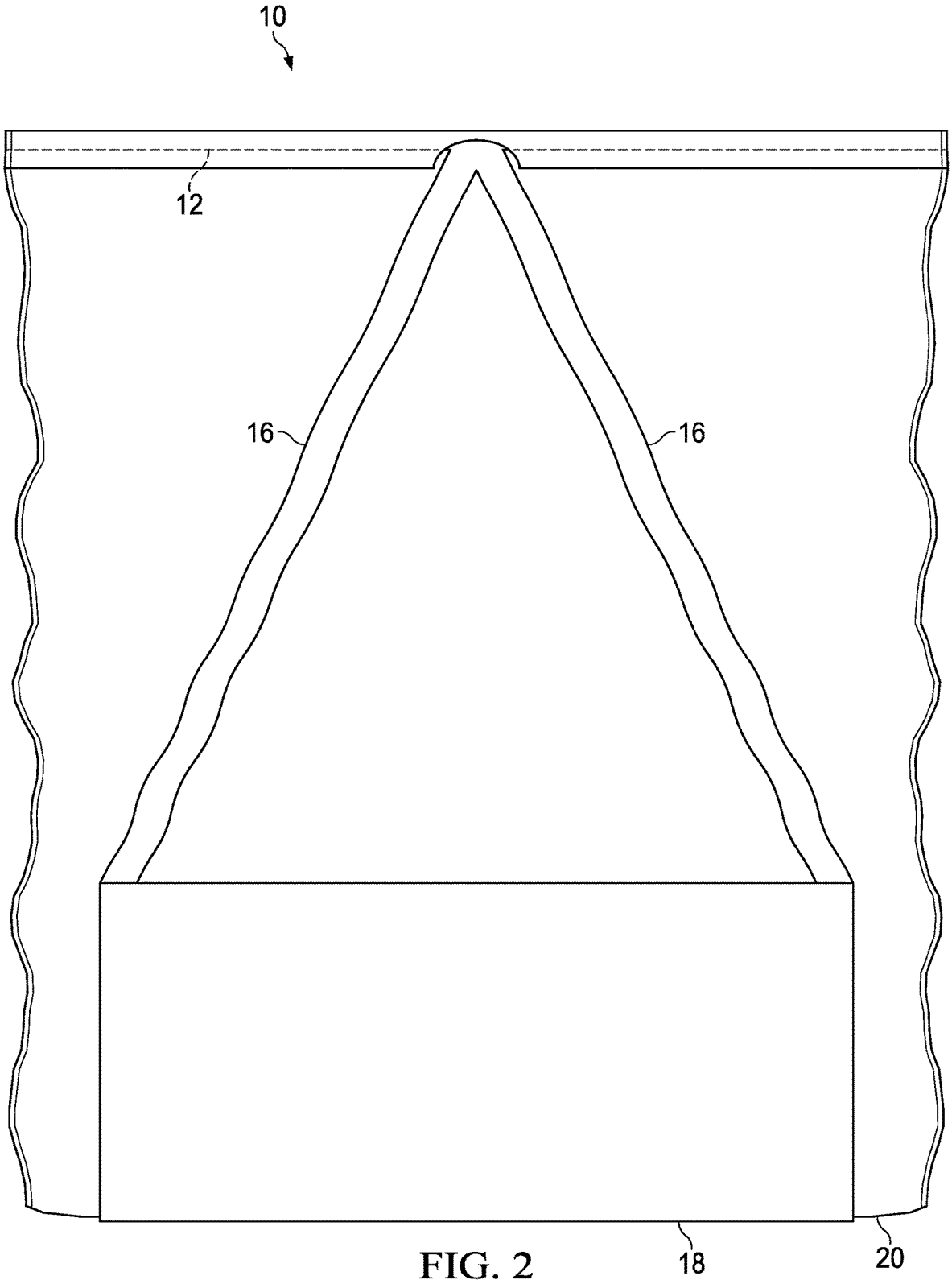
FIG. 2 is a front perspective view illustration of the invention, showing how the strap structure concept will secure the bag. Also providing observation on the slack in the support straps when the trash bag is empty.

FIG. 2 numeral 10 refers to the front view illustration that features the trash bag and support straps structure concept. Numeral 12 refers to a secured drawstring inside the hem of the numeral 20. Numeral 12 is connected to numeral 16. Numeral 16 refers to the support straps with slack along the front of numeral 20. Numeral 16 is connected to numeral 18. Numeral 18 refers to the secured support at the base of the numeral 20. Numeral 20 refers to the trash bag.

Figure 3:
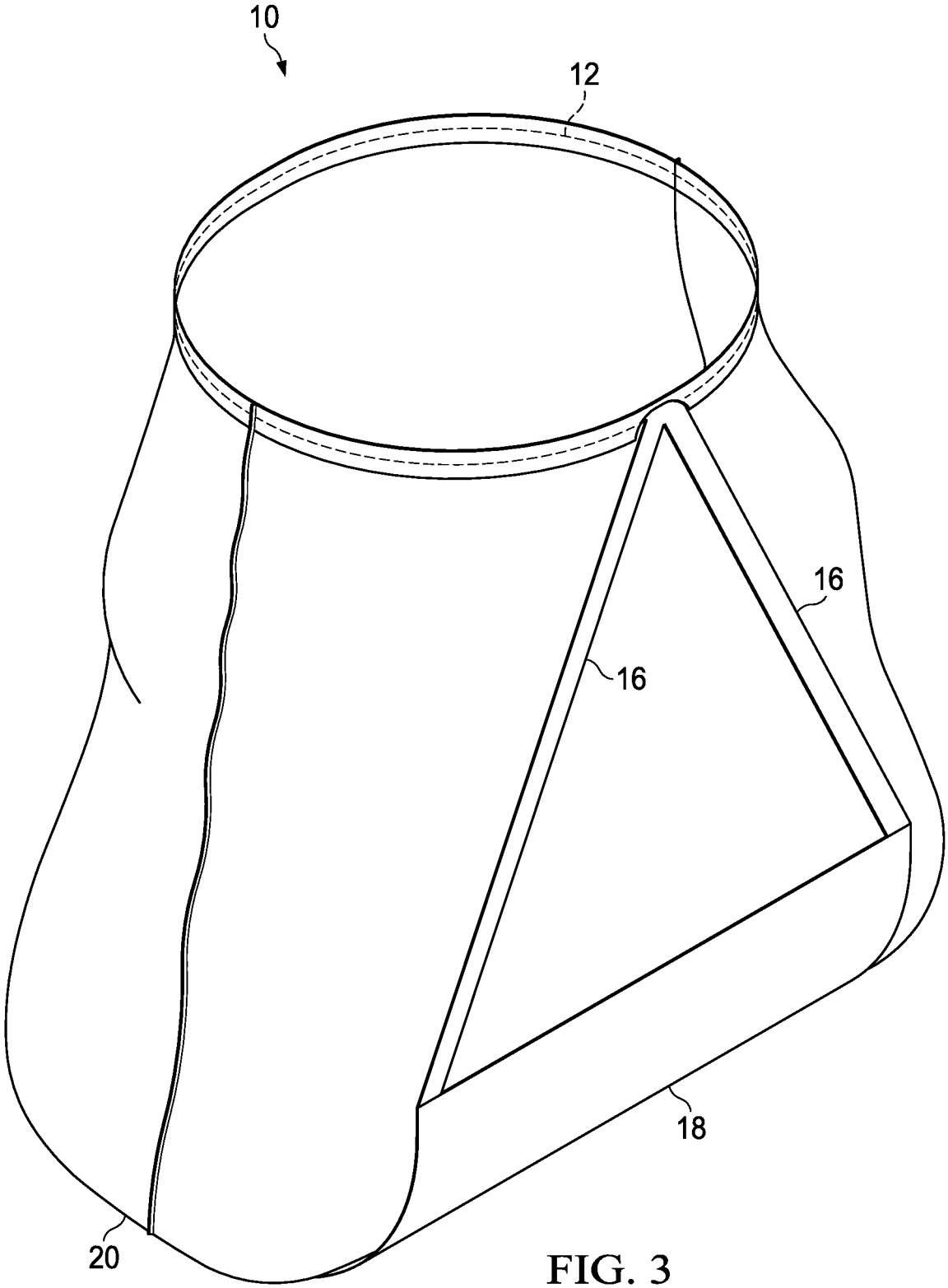
FIG. 3 is a partial side elevation view that illustrates how the support straps will fill out the trash bag once filled.

FIG. 3 numeral 10 refers to an illustration that features how a filled trash bag would look using the support straps structure concept. Numeral 12 refers to the drawstring in the hem of the open mouth of numeral 20. Numeral 16 refers to the support straps filling out along numeral

20. Numeral 18 refers to the base being secured to numeral 20. Numeral 20 refers to the trash bag within the support straps structure concept.

Figure 4:
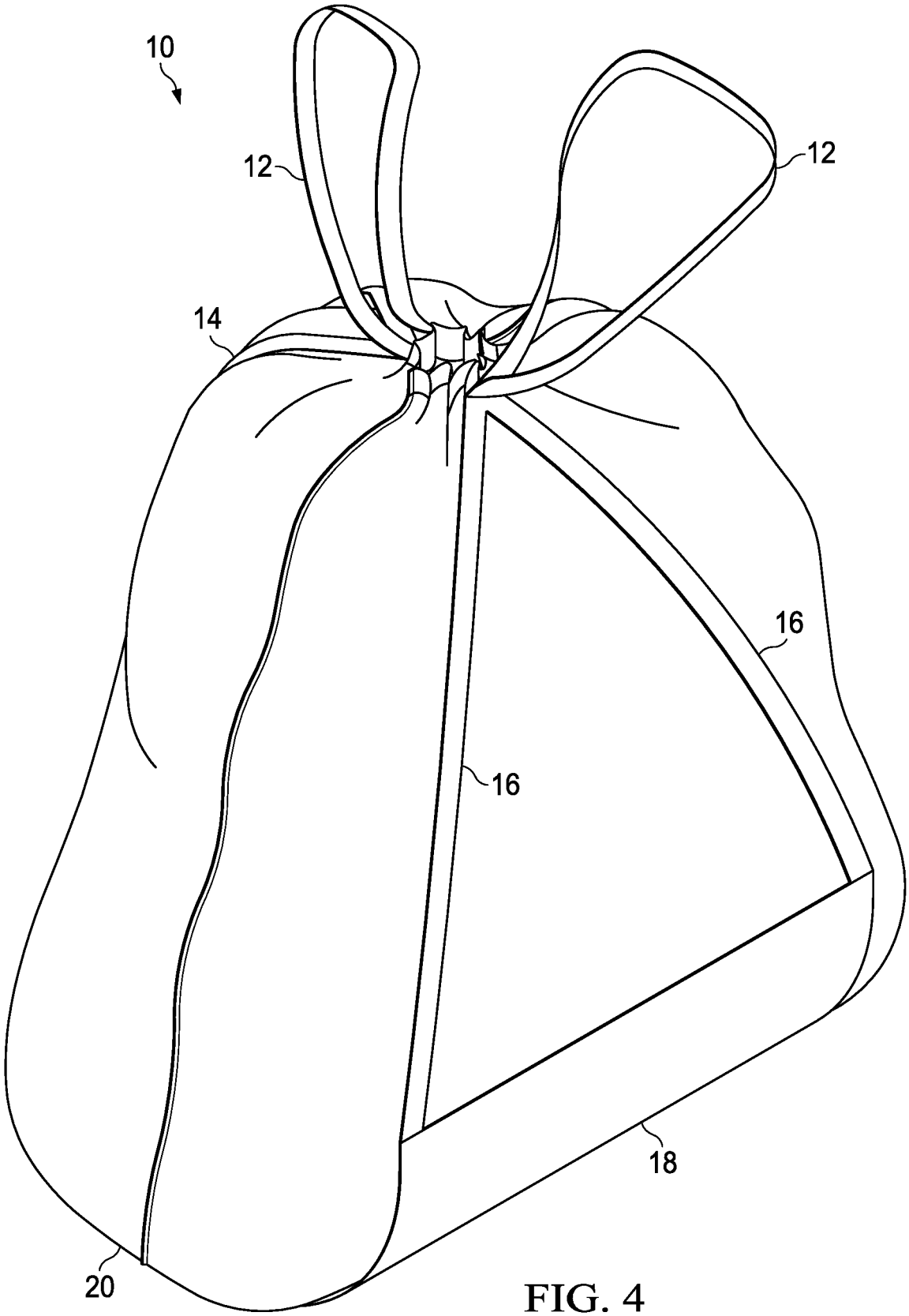

FIG. 4 numeral 10 refers to an illustration featuring a filled straps trash bag ready for disposal. Numeral 12 refers to the drawstring pulled tightly to close the mouth of numeral 20. Numeral 14 refers to support straps (left side) being filled from pulling at numeral 18. Numeral 16 refers to support straps (right side) being filled from pulling at numeral 18. Numeral 18 provides numeral 20 a secure base when pulled by numeral 14 and 16. Numeral 20 refers to the trash bag filled and being secured by the supporting straps structure concept.

The invention is designed to pull a trash bag from the bottom instead of the mouth of the trash bag. Numerals 12, 14, 16, 18 are defined as the support straps structure concept as depicted in FIG. 1; and Numerals 12, 14, 16, 18, 20 are defined as the straps trash bag as depicted in FIG. 3-4.

The invention consists of an elastic support straps structure concept, which consist of numeral 12, 14, 16 18. The support straps have slack in them, so when the trash bag is empty the straps are loose but when the trash bag is filled the supporting straps are also filled, alleviating the slack. Pulling the drawstrings in an upward motion the support straps will then tighten, since the support straps will be pulling on the support base. The improved trash bag provides a unique structure concept that is convenient when pulling trash.

The invention claimed is:

1. A trash bag system, comprising:

a trash bag composed of a plastic material, the trash bag having:

a top opening surrounded at least partially by a hem;

an outer side surface; and a bottom integral with outer surface;

a support strap assembly, having:

a first drawstring positioned within the hem of the trash bag;

a second drawstring positioned within the hem of the trash bag;

a first pair of support straps, each of the first pair of support straps extending from a first end to a second end, the first ends attached to the first drawstring at a first common connection point and the second ends extending away from the first drawstring into a first triangular shape, the first pair of support straps are positioned on the outer side surface of the trash bag;

a second pair of support straps, each of the second pair of support straps extending from a first end to a second end, the first ends attached to the second drawstring at a second common connection point and the second ends extending away from the second drawstring into a second triangular shape, the second pair of support straps are positioned on the outer side surface of the trash bag;

a support attached to the second ends of each of the first pair of support straps to complete the first triangular shape and the second ends of each of the second pair of support straps to complete the second triangular shape, the support extends underneath the trash bag, the support is secured to an outer side surface of the bottom;

wherein the attachment of the support to the first pair of support straps and the second pair of support straps and extending underneath the trash bag provides for lifting force to be applied to the underneath of the trash bag.

* * * * *